US005863227A

United States Patent [19]

Bell, Jr.

[11] Patent Number: 5,863,227

[45] Date of Patent: Jan. 26, 1999

[54] EYELET TERMINAL WITH BOLT RETAINING MEANS

[75] Inventor: Danny Ray Bell, Jr., Northville, Mich.

[73] Assignee: Yazaki Corporation, Tokyo, Japan

[21] Appl. No.: 703,448

[22] Filed: Aug. 27, 1996

[51] Int. Cl.[6] ..... H01R 11/11

[52] U.S. Cl. ..... 439/883

[58] Field of Search ..... 439/883, 868, 439/860, 439

[56] References Cited

U.S. PATENT DOCUMENTS 4,790,772 12/1988 Schulte et al. ..... 439/860
5,426,831 6/1995 Leonelli, Jr. ..... 439/883
5,453,027 9/1995 Buell et al. ..... 439/883

FOREIGN PATENT DOCUMENTS 1128425 9/1968 United Kingdom ..... 439/813

*Primary Examiner*—Gary F. Paumen
*Attorney, Agent, or Firm*—Young & Basile, P.C.

[57] ABSTRACT

An eyelet terminal comprises a substantially flat ring with a plurality of retaining arms formed around the inner circumference thereof, the retaining arms adapted to engage a bolt passing through the ring so that the terminal and the bolt are held together as a unit during shipping and handling. The retaining arms are flush with the bottom surface of the ring to avoid scratching of the surface to which the terminal is bolted, and are shaped to permit insertion of the bolt through the ring without breaking or deforming the arms.

4 Claims, 2 Drawing Sheets

EYELET TERMINAL WITH BOLT RETAINING MEANS

FIELD OF THE INVENTION

The present invention relates to eyelet terminals such as are used to connect electrical wires to ground or to other electrical system components, and more particularly to an eyelet terminal which retains a bolt in engagement with the terminal prior to bolting of the terminal to the component.

BACKGROUND OF THE INVENTION

An eyelet terminal is essentially a flat ring of electrically conductive metal for receiving a bolt or a similar connector, and a radially extending portion for connection to the end of a length of wire by crimping or soldering. Eyelet terminals are used in many types of electrical systems, including those of automotive vehicles, to connect wires to electrical ground or to other electrical system components. In a typical automotive grounding connection, the eyelet terminal is bolted to a piece of sheet metal such as a vehicle body panel. Sometimes a lock washer is inserted between the bolt head and the terminal ring to make the bolted connection more secure against vibration.

In such automotive grounding applications, the eyelet terminal and its attached wire, the bolt, and the lock washer are typically shipped to the vehicle final assembly plant as separate components, then assembled with one another immediately prior to being bolted to the body panel. This assembly technique is more time consuming, more expensive, and more prone to human error than if the parts were shipped and assembled to the vehicle as a unit.

Some eyelet terminals include projections or serrations on the lower surface of the ring for cutting into the sheet metal slightly when the terminal is bolted tightly against the body panel, and thus ensuring better electrical contact than is provided by mere planar contact between the terminal and the metal. The scratches formed in the metal by the serrations, though, promote the formation of corrosion.

SUMMARY OF THE INVENTION

It is an object of the invention to provide an eyelet terminal capable of securely retaining a bolt during shipping and handling of the terminal.

Another object of the invention is to provide an eyelet terminal into which a bolt can be easily inserted, but which holds the bolt securely once it is inserted.

A further object of the invention is to provide an eyelet terminal having bolt retaining arms that are resistant to breakage or bending during insertion of the bolt into the terminal.

Still another object of the invention is to provide a retainer which does not cause corrosion when the terminal is attached to a surface.

According to the present invention, these objectives are achieved by an eyelet terminal comprising a substantially flat ring with a central aperture for insertion of a bolt and a plurality of retaining arms extending radially inward from the inner circumferential edge of the ring to engage the threads of the bolt and thereby retain the bolt within the terminal. The retaining arms are of the same thickness as the ring at their outermost ends where they are joined to the ring, thus providing sufficient stiffness and strength to avoid permanent bending or breakage, but are thinner than the ring over most of their lengths, chamfered transitions located at the outermost ends of the arms providing a taper between the two thicknesses. The lower surfaces of the retaining arms are co-planar with the bottom surface of the ring, so that the arms do not protrude downwardly so as to scratch a surface to which the terminal is bolted.

The innermost ends of the retaining arms have rounded edges oriented toward their upper sides to ease passage of the bolt as it is inserted through the ring, but square edges oriented toward their lower sides to make it more difficult for the bolt to pass through the ring in the opposite direction and thereby become disengaged from the terminal.

DETAILED DESCRIPTION OF THE PREFERRED EMBODIMENT

Figure 1:
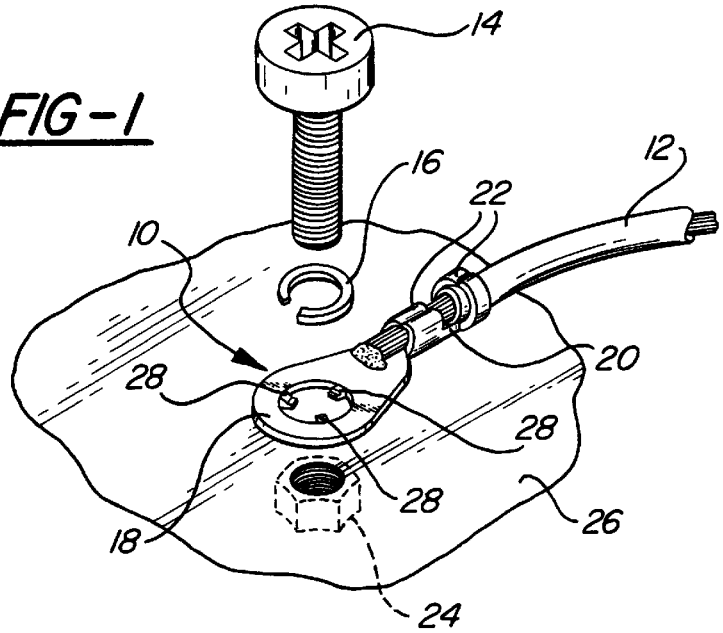
FIG. 1 is an exploded perspective view of an eyelet terminal according to the present invention along with a bolt and lock washer.
Figure 2:
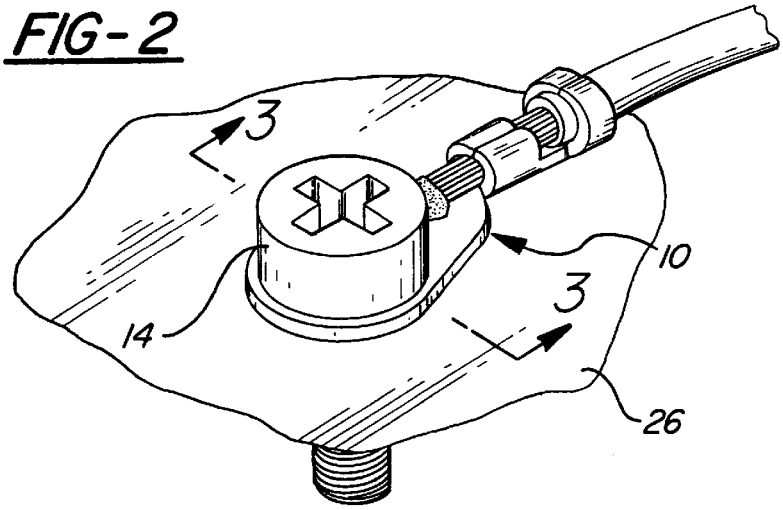
FIG. 2 is a perspective view of the eyelet terminal, bolt and lock washer of FIG. 1 in an assembled condition.

Referring to FIGS. 1 and 2, an eyelet terminal 10 according to the present invention is shown attached to an electrical wire 12 and in combination with a bolt 14 and an optional lock washer 16. Eyelet terminal 10 is formed of an electrically conductive metal such as steel or aluminum, preferably by a conventionally known metal stamping process, and comprises a flat ring 18 and a wire connecting stem 20 extending radially outward from the outer edge of the ring. Wire connecting stem 20 has crimping tabs 22 projecting toward a top surface of eyelet terminal 10 to encircle wire 12, while the opposite bottom surface of the terminal is substantially planar. In operation, eyelet terminal 10 is fastened to an electrically grounded panel 26 (as shown in FIG. 2) by passing bolt 14 through lock washer 16 and eyelet terminal 10, then threading the bolt into connection with a nut 24 or the like welded to the panel. Bolt 14 is then tightened to urge the bottom surface of the eyelet terminal firmly against the panel 26 to achieve good electrical contact therewith.

Figure 3:
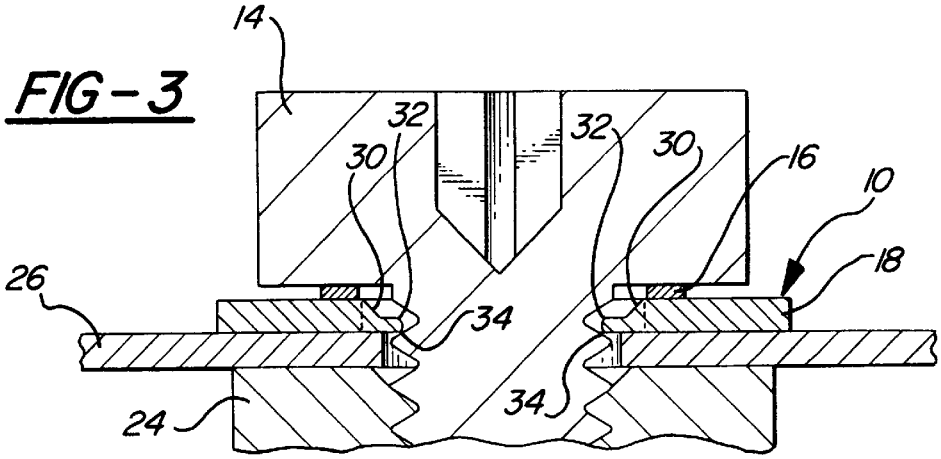
FIG. 3 is a sectional view taken along line 3—3 of FIG. 2.
Figure 5:
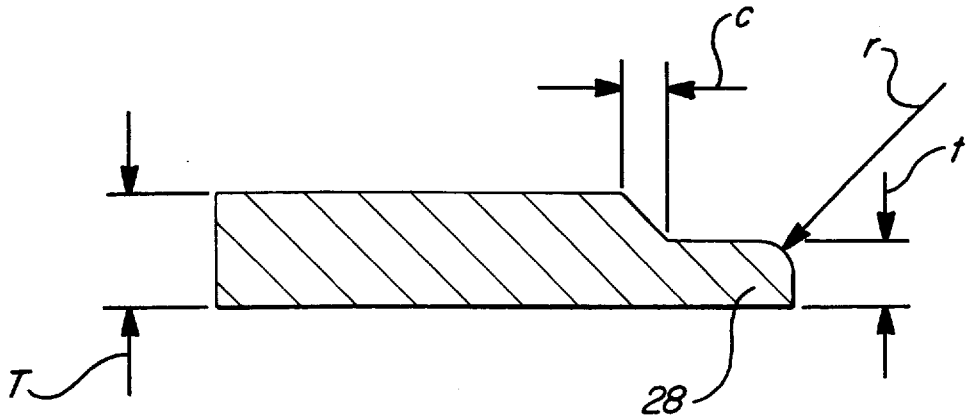
FIG. 5 is a partial sectional view taken along line 5—5 of FIG. 4.

A plurality of retaining arms 28 are formed integrally with ring 18 and project radially inwardly from the inner circumferential edge thereof. The preferred embodiment depicted has three retaining arms, but any number of arms greater than two are considered to be within the scope of the invention. As best seen in FIGS. 3 and 5, each retaining arm 28 is equal in thickness to ring 18 at the end where the arm is joined to the ring and has a chamfered transition 30 tapering down to a tip section having a smaller thickness over the majority of the length of the arm. The lower surface of each retaining arm 28 is flat and substantially coplanar with the bottom surface of ring 18. The radially innermost end of each retaining arm 28 has an end surface which meets the upper surface of the arm at a rounded upper edge 32, and which meets the lower surface of the arm a right-angled lower edge 34.

The innermost ends of retaining arms 28 define a central aperture having an inner diameter slightly smaller than the outside diameter of the threads of bolt 14 so that, as seen in FIG. 3, a small amount of physical interference exists between the two parts when the bolt is inserted into eyelet terminal 10. As bolt 14 is inserted into engagement with terminal 10 by urging it downward through ring 18, the rounded upper edges 32 make it relatively easy for the threads on the bolt to slip past retaining arms 28, and retaining arms 28 are thin enough to deflect slightly as the bolt passes through. The retaining arms then spring back to their original, undeflected positions wherein they engage the bolt threads sufficiently to hold the bolt captive within the terminal. Accordingly, it requires only a small amount of effort for a person to press bolt 14 through ring 18 by hand.

Once bolt 14 is inserted into ring 18, withdrawal of the bolt from the ring requires that the bolt threads be urged past the right-angled lower edges 34 on retaining arms 28. The threads tend to bind on the right-angled lower edges 34 on retaining arms 28, rather than slipping easily past the rounded upper edges 32, thus making it more difficult for the bolt to be withdrawn from terminal 10. Bolt 14 and eyelet terminal 10 may thus be assembled into a unit prior to being shipped to a vehicle assembly plant and are unlikely to inadvertently become disengaged from one another before being bolted into connection with a panel or other component.

Chamfered transitions 30 provide retaining arms 28 with greater strength than arms having a constant, thin cross-section, and prevent undesirable stress concentrations at the points where the arms meet ring 18. Urging of bolt 14 through ring 18 is thus unlikely to cause retaining arms 28 to break, or to become permanently deformed in a downwardly bent position such that the arms would scratch or gouge the surface to which eyelet terminal 10 is bolted.

Figure 4:
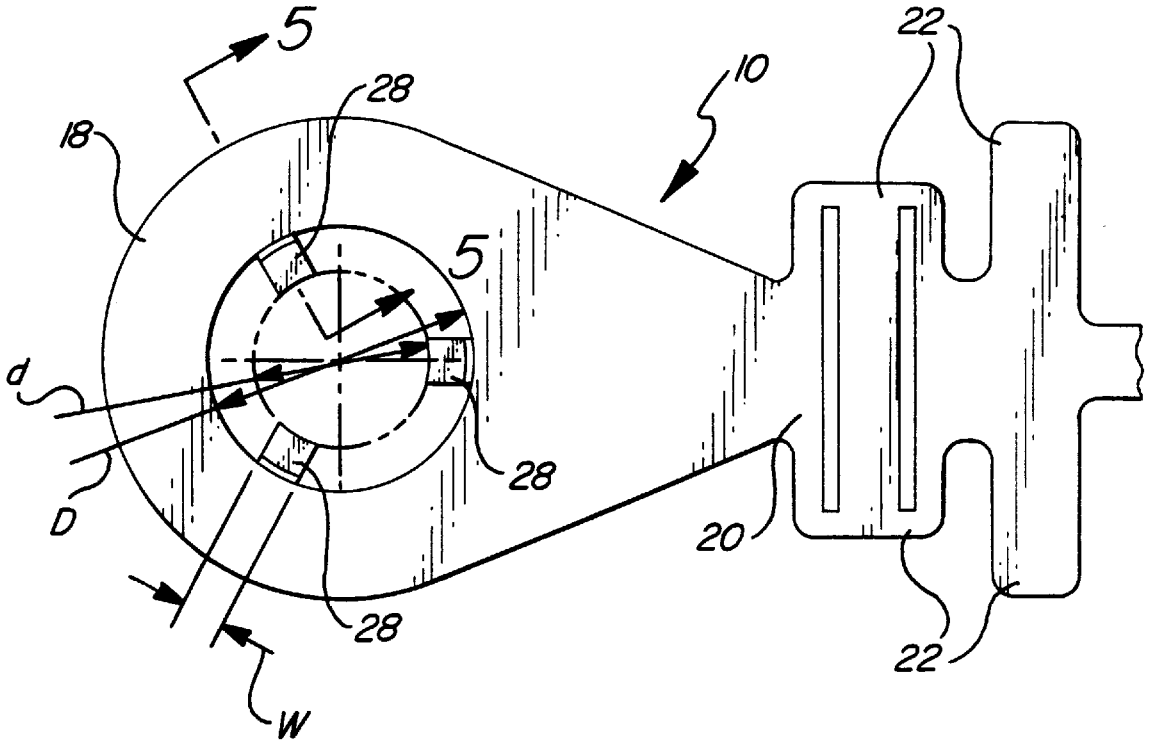
FIG. 4 is a plan view of the eyelet terminal.

The various dimensions of an eyelet terminal according to the invention will vary depending upon the size of bolt used and the thickness of eyelet terminal 10. For example, an eyelet terminal intended for use with a ¼ inch UNF bolt may have the following approximate dimensions, the reference letters corresponding to those indicated in FIGS. 4 and 5: a ring thickness T=0.72 mm, a ring inner diameter D=7.00 mm, a retaining arm inner diameter d=4.70±0.05 mm, a retaining arm width w=1.20 mm, a retaining arm thickness t=0.42 mm, a chamfer length c=0.30 mm, and an upper edge radius r=0.20±0.05 mm.

Whereas a preferred embodiment of the invention has been illustrated and described in detail, it will be apparent that various changes may be made in the disclosed embodiment without departing from the scope or spirit of the invention.

The invention claimed is:

1. An eyelet terminal comprising wire connection means, a substantially flat ring integral with the wire connection means, and a plurality of retaining arms extending radially inward from an inner circumferential edge of the ring to define a central aperture sized to be engagable with a bolt and retain the bolt within the eyelet terminal, the ring being of a first thickness and having a top surface and an opposite bottom surface, the eyelet terminal characterized in that:

each of the retaining arms comprises a tip section of a substantially constant thickness smaller than the thickness of the ring and a chamfered transition between the ring and the tip section, the tip section having a lower surface substantially coplanar with the ring bottom surface and an opposite upper surface substantially parallel to the lower surface.

2. An eyelet terminal according to claim 1 wherein the tip section of each retaining arm has an end surface distal from the ring, the upper surface and the end surface meeting at an upper edge, said upper edge being rounded.

3. An eyelet terminal according to claim 1 wherein the tip section of each retaining arm has an end surface distal from the ring, the lower surface and the end surface meeting at a lower edge, said lower edge being a right angle.

4. An eyelet terminal comprising:

a substantially flat ring of a first thickness and having a top surface, a bottom surface, and an inner circumferential edge;

wire connection means integral with the ring and extending radially therefrom; and a plurality of retaining arms extending radially inward from the inner circumferential edge of the ring for engaging a bolt and retaining the bolt within the ring, the retaining arms being of a second thickness less than the first thickness, each retaining arm having a) a first end connected to the ring and comprising a chamfered transition tapering from the first thickness to the second thickness, b) an end surface distal from the ring, c) a lower surface substantially coplanar with the bottom surface of the ring, the lower surface and the end surface meeting at a lower edge, said lower edge being a right angle, and d) an upper surface parallel to the bottom surface and oriented toward the top surface of the ring, the upper surface and the end surface meeting at a rounded upper edge.

* * * * *